US005791419A

United States Patent [19]

Välisalo

[11] Patent Number: 5,791,419

[45] Date of Patent: Aug. 11, 1998

[54] DRILLING APPARATUS FOR REPLACING UNDERGROUND PIPES

[75] Inventor: Risto Välisalo, Ikaalinen, Finland

[73] Assignee: RD Trenchless Ltd. Oy, Ikaalinen, Finland

[21] Appl. No.: 718,001

[22] Filed: Sep. 13, 1996

[30] Foreign Application Priority Data

Sep. 14, 1995 [FI] Finland ..... 954309

[51] Int. Cl.[6] ..... E21B 7/28; E03F 3/06

[52] U.S. Cl. ..... 175/53; 405/184

[58] Field of Search ..... 175/53; 405/184, 405/154

[56] References Cited

U.S. PATENT DOCUMENTS

| | | | |
|---|---|---|---|
| 4,043,136 | 8/1977 | Cherrington | 185/53 |
| 4,117,895 | 10/1978 | Ward et al. | 175/53 |
| 4,648,746 | 3/1987 | Abinett | 405/184 |
| 4,878,547 | 11/1989 | Lennon | 175/53 |
| 4,915,543 | 4/1990 | Akesaka | 405/184 |
| 5,096,000 | 3/1992 | Hesse | 405/184 X |
| 5,238,073 | 8/1993 | Rear | 175/53 |
| 5,403,122 | 4/1995 | Granella | 405/184 |

FOREIGN PATENT DOCUMENTS

| | | | |
|---|---|---|---|
| 832325 | 1/1970 | Canada | 175/53 |
| 0 507 610 | 10/1992 | European Pat. Off. . | |
| 1572253 | 7/1980 | United Kingdom | 405/184 |
| 2 137 720 | 10/1984 | United Kingdom . | |
| WO 95/22677 | 8/1995 | WIPO . | |

*Primary Examiner*—Hoang C. Dang
*Attorney, Agent, or Firm*—Pollock, Vande Sande & Priddy

[57] ABSTRACT

The present invention relates to a drilling apparatus provided for drilling away an existing underground pipe and for replacing it with a new pipe. The apparatus comprises a tubular body; a percussive drill bit slidably connected to an end of the tubular body where the drill bit is capable of reciprocating movement with respect to the tubular body; a device for moving the percussive drill bit with respect to the tubular body to perform drilling operations at a drilling location; a guiding element fixedly connected to the tubular body and axially passing through the tubular body and the drill bit to connect, in a direction of travel of the drilling apparatus, to a device causing the advancing movement of the tubular body. The guiding element and the percussive drill bit are axially movable relative to each other to prevent impacting movements from the drill bit from being transmitted to the guiding element. A centering element consisting of a conveyor for conveying drill cuttings forward from the drilling location is also provided. The centering element is mounted on the guiding element.

2 Claims, 5 Drawing Sheets

- PRIOR ART -

DRILLING APPARATUS FOR REPLACING UNDERGROUND PIPES

TECHNICAL FIELD

The present invention relates to a drilling device, by which an existing underground pipe is drilled or renovated. The invention relates also to a method for drilling the pipe.

BACKGROUND OF THE INVENTION

When, for example, an existing underground sewer network is drilled for renovating sewer pipes, the problem is to guide the drilling apparatus in a manner that it follows the course of the existing pipe, which is to be renovated, that is, replaced with a new pipe. Problems rise usually because the guiding element of the drilling apparatus is connected to the percussive drill bit in such a fashion that it has a tendency to transmit the impact energy further to the pipe to be drilled, simultaneously breaking it and preventing the guiding element from staying inside the old pipe to be drilled. Another possible cause is that because the drilling apparatus is fed by pushing it in its advancing direction, the torsional moment of the feed tubes of the drilling apparatus will further divert the drilling apparatus away from the desired original direction. A guide element attached to the front side of the percussive drill bit assembly is movable together with the percussive movement of the drill bit and makes the apparatus difficult to steer. Such a solution is known for example through International Publication WO95/22677.

The problems of this known method, taken together, make the steering of the drilling apparatus to the desired direction very difficult, and in some cases even impossible.

SUMMARY OF THE INVENTION

The purpose of the present invention is to eliminate this problem and to provide a drilling apparatus which is more reliable in operation. For achieving this purpose, in the drilling apparatus the guiding element is attached to a structure, with respect to which the percussive drill bit assembly is movable for effecting its percussive movement. Hence, the guiding element located in front of the percussive drill bit, and the drill bit itself, have the possibility of mutual relative movement in the axial direction. The guiding element can be connected to the body of the drilling apparatus and led in axial direction to the front side of the percussive drill bit assembly in such a manner that the impacting element of the drill bit is not dependent upon the impacting movement of the drill bit. Through the element it is also possible to supply to the drilling apparatus at least one of the forces it needs, such as rotation, advancing force as well as the medium required by the percussion tool.

During the drilling operation, the forces needed for steering the drilling apparatus are transmitted through a drill string to the drilling apparatus in such a fashion that the individual sections, drill rods, constituting the drill string are fed into the existing pipe, whereafter they can transmit to the drilling apparatus, through the guide element, the needed rotation, traction, push as well as the medium needed by the actual impact tool from the advancing direction of the drilling apparatus. In this way, the advancing of the drilling apparatus to the desired direction is guaranteed and possible interfering torsional moments are minimized.

The element led axially through the percussive drill bit can be formed in a variety of ways. Most preferably it can be formed to constitute a tube or rod passing axially through the percussive drill bit to the inside of the drilling apparatus body.

The element passing axially through the percussive drill bit, a solid rod or a tube containing a conduit, is most preferably joined fixedly to the body of the drilling apparatus, that is, it is not movable in relation to the body, which in turn forms the support and thrust for the impacting force of the reciprocating drill bit. The element can be joined to the body and also be axially movably to some extent, but also in this case the movement of the guiding element is not dependent on the percussive movement of the drill bit assembly, but moves the drilling direction governed by the advancing movement of the body. An impact means reciprocating with respect to the body impacts on the back side of the drill bit or drill bit assembly in a known manner.

It is also possible that the forces needed by the drilling apparatus or part of the forces are/is supplied in usual manner at the rear end of the drilling apparatus, in which case the non-impacting guide element serves to supply a part, or none, of the forces needed by the drilling apparatus.

BRIEF DESCRIPTION OF THE DRAWINGS

The invention will be more fully understood in light of the following description, where reference is made to the accompanying drawings in which.

DETAILED DESCRIPTION OF THE PREFERRED EMBODIMENTS

In this context, for the parts of the drilling apparatus, the following designations are used: drilling apparatus body is a coherent part, on which the drill bit is mounted and which is moved in the direction of the pipe to be renovated; impact tool means the body and the drill bit mounted thereon; and drill bit assembly means a part performing the percussive movement in the foremost position with respect to the body and constituted of one piece or several interconnected pieces.

Figure 1:
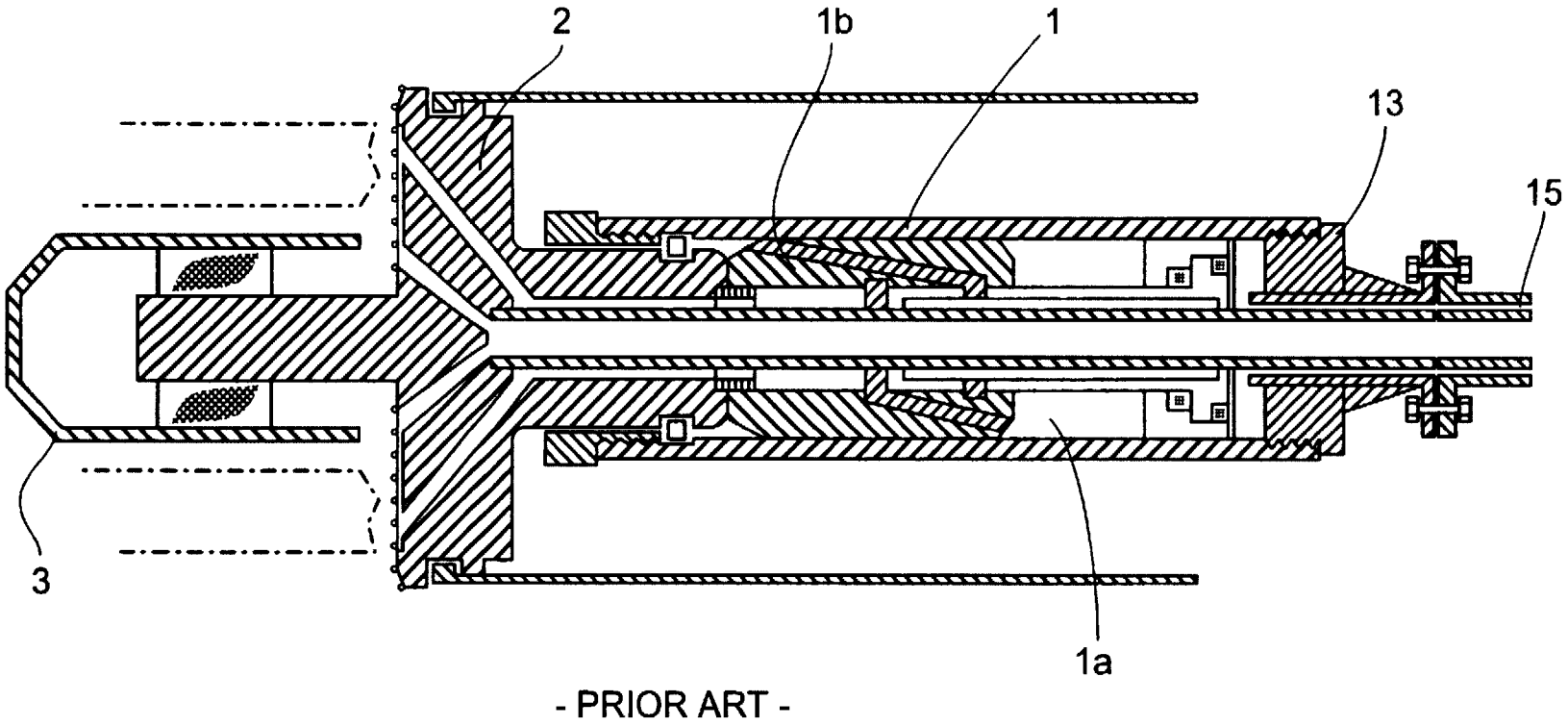
FIG. 1 shows a known drilling apparatus in a section taken in axial direction.

FIG. 1 shows the present prior art showing an impact tool. The impact tool comprises a body 1 containing a work space 1*a* for the pressured medium needed by the impact force as well as a piston 1*b* moved by the medium and arranged to transmit the movement to the percussive drill bit assembly 2 movable with respect to the body, as well as a guiding element 3 coupled to the percussive drill bit assembly. The guiding element 3 can be coupled in many ways to the percussive drill bit assembly 2, however, in a manner that the guiding element 3 would not tend to break in advance of the pipe to be drilled, but would move along inside it and guide the following drill bit assembly 2, which laterally (in radial direction) extends wider than the guiding element 3, in the figure slightly beyond the walls of the old pipe designated by dot-and-dash lines. The drill bit assembly crushes the walls by its percussive movement. If guiding element 3 has the percussion ability, it is likely to break the pipe to be renovated and be unable to center the impacting drill bit assembly 2 and keep the drilling apparatus aligned with the pipe to be renovated. The forces needed by the drilling apparatus of FIG. 1 are supplied along a drill string 5 from the starting direction of the drilling apparatus. These forces include the rotation and force of advancement (push) needed by the drilling apparatus, and the medium needed for driving the drilling apparatus.

Figure 2:
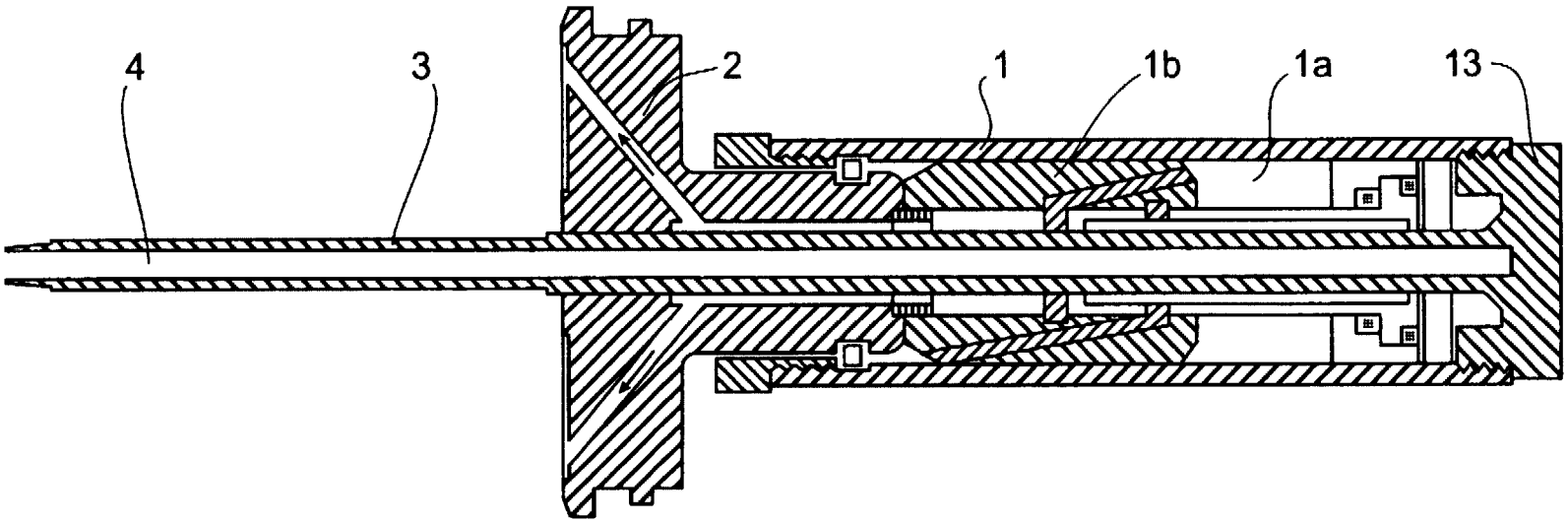
FIG. 2 shows a drilling apparatus according to the invention.

FIG. 2 shows a drilling apparatus according to the invention, comprising an impact tool, which includes the body 1 of the drilling apparatus containing a work space 1*a* and a piston 1*b* movable with respect thereto. The impact tool further includes a percussive drill bit assembly 2 movable relative to the body 1. The drilling apparatus has a guiding element 3 extending from the impact tool and being passed through the percussive drill bit. As is apparent from the figure, the guiding element 3 has the capability of axial relative movement with respect to the percussive drill bit assembly 2, and it moves together with the body 1 as one kinetic entity towards the advancing direction, whereby transmission of impacting forces to the guiding element 3 is avoided. Inside the guiding element 3 is shown the conduit 4 for pressurized medium needed by the impact tool. The medium is supplied along the conduit further into the body 1 via an element 13 disposed in the rear part of the body. The conduit is passed axially through the drill bit assembly 2, through the piston 1*b* and through the work space 1*a* down to the distribution element 13 located in the rear part of the body and receiving a tubular piece forming the outer shell of the body, the element and the tubular piece being attached to each other by an outer threading and inner threading, respectively. From this distribution element, channels open to the work space 1*a*, where the piston 1*b* is moved back and forth according to a principle known as such by one skilled in the art.

In the practical solution, the guiding element 3 is led through a bore formed in the drill bit assembly 2. The annular drilling region surrounding the lead-in place on the front face of the drill bit assembly and positioned substantially perpendicularly to the advancing direction of the drilling operation, will receive its impact energy from the common piston 1*b* movable with respect to the body.

Figure 3:
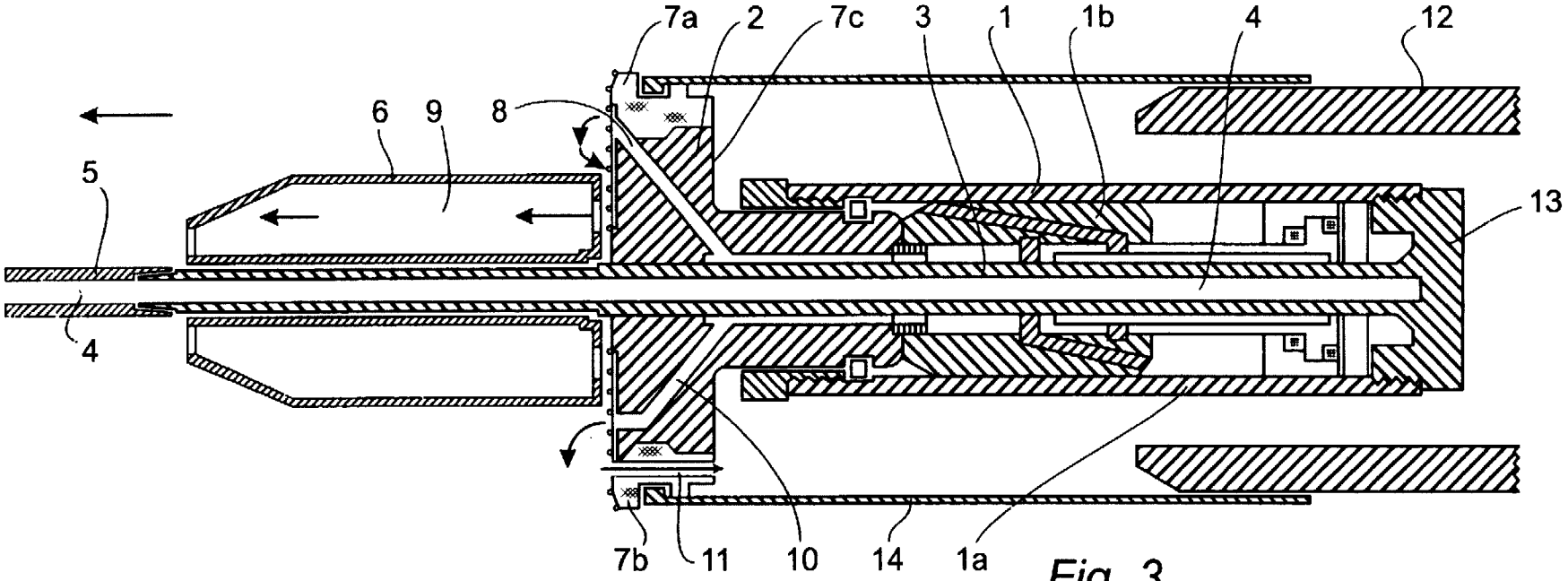
FIG. 3 shows a drilling apparatus according to the invention together with a guiding element.

FIG. 3 shows the invention and its realization, which consists of the impact tool including the body 1 and the percussive drill bit assembly 2. The drilling apparatus further includes the guiding element 3. The percussive drill bit assembly in turn consists of a ring bit 7*a* or 7*b*, inner bit 7*c* and a drill bit collar, which can be integral with the inner bit. As seen from the advancing direction, the ring bit is the outermost changeable annular piece of the circular drill bit assembly 2, and it can be used to adapt the drill bit diameter to the diameter of the pipe to be drilled. In the drawing reference signs 7*a*, 7*b* denote different shapes of the ring bit related to flow alternatives of drill cuttings.

The guiding element 3 shown in the figure is capable of moving axially with respect to the percussive drill bit assembly, and thus it is unable to transmit impact forces. Because the guiding element 3 is connected to the body 1 of the impact tool to be immobile with respect thereto during its advancing movement, the impact tool can be supplied with the needed forces along the guiding element, such forces including the force for advancement, rotation, and the medium needed by the impact tool, all from the direction of travel of the drilling apparatus, that is, the supply direction is opposite to the direction of advancement or travel of the impact tool. These forces are transmitted to the front end of the guiding element 3 for example along a drill string 5 connected through a threading, further to the guiding element 3, and therefrom finally to the impact tool. A radially wider centering portion 6 is mounted on the guiding element 3, most preferably in such a manner that it is capable of moving axially with respect to the guiding element 3, thus having the smallest possible tendency to break the pipe to be renovated. The centering element 6 can be constructed freely rotatable or rotatable together with the guiding element 3. Its possible stroke length in relation to the guiding element 3 can be dimensioned in such a fashion that if it, for example, gets stuck in the pipe to be renovated, the impacting drill bit assembly will be able to release it. The arrows shown in the figure show the direction of travel of the flushing medium and drill cuttings. The arrows in the upper part of the figure represent the forward movement of the drill cuttings, whereas the arrows in the lower part represent its movement backwards. The drill cuttings can also be led to both directions at the same time.

The percussive drill bit assembly shown in the figure consisting of the inner bit 2 and the ring bit 7*a* or 7*b* is coupled at the outer edge through a rotation coupling to a protective tube 14 surrounding the body 1, the coupling being made in a manner that it is also capable of moving axially to some extent by virtue of axial clearance between the drill bit assembly and the protective tube. The drawing also shows a pipe 12 to be installed, which for example can be pushed from behind or pulled with the drilling apparatus itself, the pipe being in the latter case attached to the body 1 of the drilling apparatus.

In case of lightweight pipes, both the apparatus and pipes mounted at its rear portion can be pulled. In case of heavier pipes the apparatus is both pulled in the direction of drilled rod and the pipes to be installed are pushed from behind concurrently according to the advancement of the drilling apparatus. The attachment of the guiding element 3 to the impact tool itself is effected through a part 13 located in the rear end of the body 1 in such a manner that it further transmits the forces to the impact tool. However, the attachment can be arranged in a variety of ways, and the drawing represents only one possibility. Also, the outlet openings of the medium of the impact tool, denoted in the figure by reference numerals 8 and 10, as well as the guiding passages 8 and 11 for the drill cuttings, can be arranged in various ways. In the upper part of FIG. 3, a channel 8 for flushing medium opens through the drill bit assembly 2 to the impact face of the drill bit. Channel 8 urges the drill cuttings further through the hollow interior part 9 of the centering element 6 to the front side thereof. In the lower part is shown an alternative, where a channel 10 opens to the impact face of the drill bit, and in radial direction in an outer position therefrom, a channel 11 is passed through the drill bit assembly 2, for example through the ring bit 7*b*. Through this channel 114 the cuttings are urged into a space between the protective tube 14 and the body 1, wherefrom they are led backwards. In both cases, the cuttings can be removed with a helix introduced from the front or from behind forwards or backwards, respectively, or with another discharge method or, for example, suction.

Figure 4:
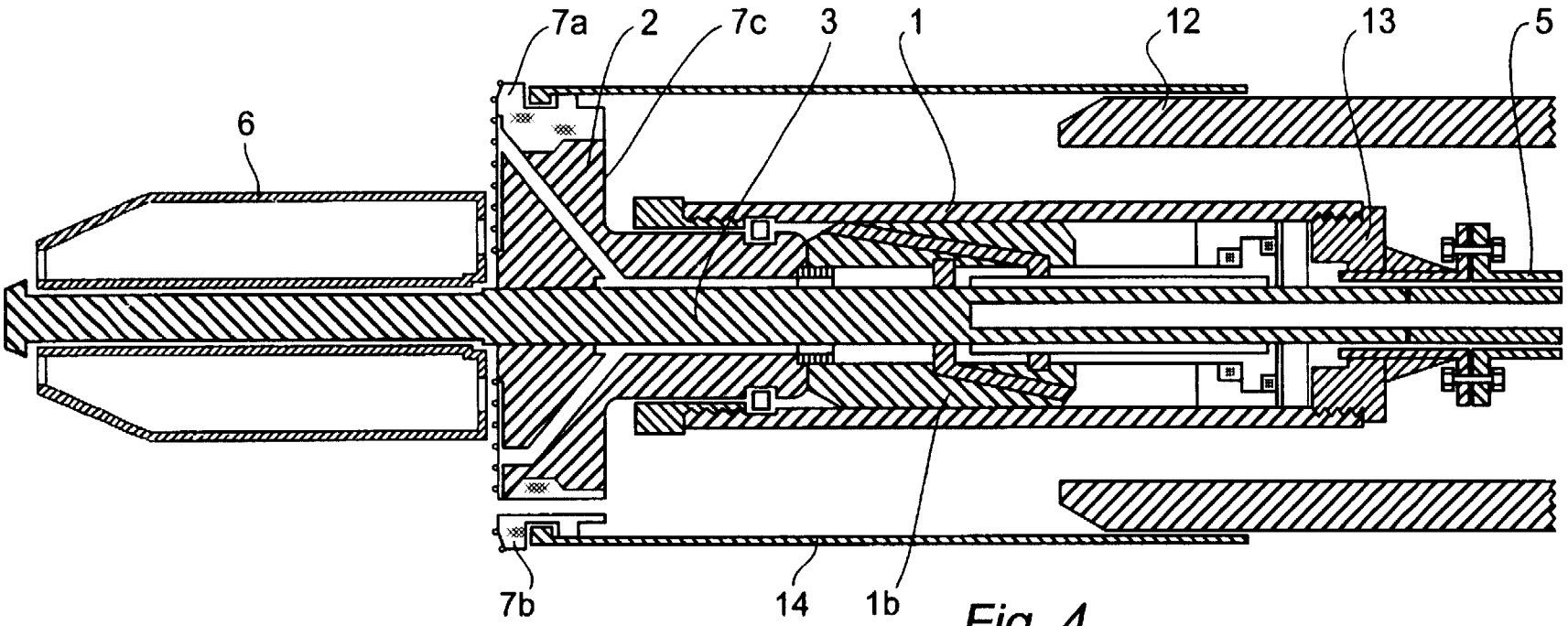
FIG. 4 shows another embodiment of the drilling apparatus according to the invention.

FIG. 4 shows a feasible embodiment of the invention, provided the forces for the impact tool, such as advancing movement and rotation, as well as the medium, are all supplied in the departing or start direction of the drilling apparatus through the drill string 5 shown in FIG. 4 to the impact tool via the element 13 of the rear end of the body 1. Because the guiding element 3 is hence not made to feed, for example, pressurized medium, it can be closed at its end (as shown in the drawing), because it is now to be used only for the point of attachment of the centering element 6. The guiding element 3 is capable of moving axially with respect to the percussive drill bit assembly 2 which also, in this embodiment, comprises of a ring bit 7*a* or 7*b* and the inner bit 7*c*. Also, in this construction, there is the possibility to supply one or several forces required by the operation of the apparatus through the guiding element 3, such as the advancing movement (traction).

In the guiding element 3, which is supported by the body 1 of the drilling apparatus, there is in radial direction (i.e in a direction perpendicular to the longitudinal direction of the pipe to be drilled) a wider centering element 6, which, as mentioned hereinabove, can be freely rotating with respect to the element 3, or provided for rotation together therewith. The centering element 6 can be dimensioned according to the inner diameter of the pipe to be drilled away, and it can also be arranged to be releasable from the guiding element 3 and replaceable with a new one, always according to the pipe size.

Figure 5:
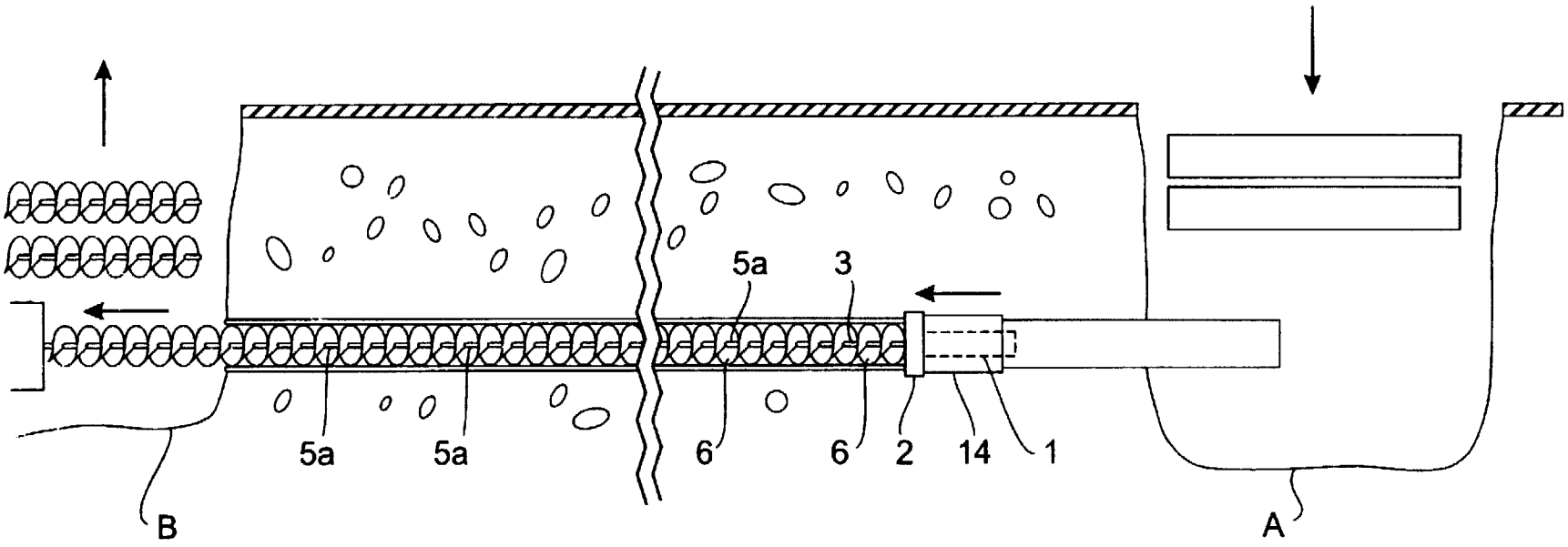
FIG. 5 shows the drilling principle when drilling a pipe below the ground.

FIG. 5 shows a case where the principle of operation is the same as in the embodiment of FIG. 3. The centering element 6 is formed of a conveyor moving the drill cuttings forwards to the drilling direction, the conveyor thus being provided around the guiding element 3. The conveyor is a helical screw attached around the guiding element 3 containing also the conduit 4 for the medium, and it is provided for rotation together with the rotational movement of the guiding element. Similar helical screws exist also in successive sections 5*a* of the drill string 5 fixed on the front side of the element, which, in a way, form the forwardly directed extensions of the guiding element 3 attached to the body 1. The widths of the helical screws can vary along the conveyor screw system thus formed within the pipe to be drilled, and the helical screws closer to the body 1 are preferably wider. The width of the helical screws is also dimensioned according to the pipe sizes. It is also possible that the guiding element 3 passed through the drill bit assembly is so short that it does not have a helical screw, and the first helical screw is disposed around the first section of the drill rod 5 to be joined to the guiding element.

The discharge of the drill cuttings forwards into the drilling direction is advantageous because there is no need to guide it past the body of the drilling apparatus behind the body, but it can be conveyed right from the place it is produced, forwards along the still intact pipe. The conveyor construction, most preferably a helical element, forms at the same time a construction that guides and centers well the drilling apparatus within the pipe.

FIG. 5 shows also the general drilling principle. At both ends of the underground pipe section to be drilled away and renovated there have been dug a start shaft A and a finish shaft B in the ground. The body 1 of the drilling apparatus is in the start shaft, and in the finish shaft sections 5*a* of the drill string 5, equipped with conveyor screw structures, are joined end-to-end together and fed along the pipe backwards until their rear end reaches the start shaft A, where they are connected to the body 1. Starting from the start shaft A, pipe sections forming the new pipe are fed, one after the other, after the body 1 of the drilling apparatus to replace the old pipe, the feeding being performed concurrently according to the advancement of the drilling from the start shaft A towards the finish shaft B, and simultaneously drill string sections 5*a* are taken away. Both the supply of the pressurized medium and the moving force required by the drilling apparatus (advancing movement and rotation) can be provided by a machine located in the finish shaft B, the machine being, in this case, a traction and rotation unit, analogical to previously known pushing and rotation units. The force of movement can be alternatively transmitted additionally, or solely from behind, by means of a drill string fed after the body 1 within the new pipe from the start shaft A. In this case, a rotation and pushing unit located in the start shaft A is utilized. From this location on also the pressurized medium can be fed, in which case the solution resembles that of FIG. 4 with the difference that also in this case the above-mentioned drill string 5 carrying the helical screw conveying the drilling waste forwardly acts as the centering structure.

In its most preferable form the drilling apparatus is, however, such that both the rotative and tractive force are introduced from the front, that is, through the existing pipe, whereby through the rotative movement of the drill string 5 and by virtue of the helical screw structure forming a kinetic entity therewith, also conveying of the cuttings forwards will be possible. The pressurized medium required by the percussive action, such as pressurized air, is most preferably supplied through the drill string 5 as well. If some of the forces needed by the drilling apparatus must be brought from behind, it is most advantageously the pressure air causing the percussive movement, because the compressor needed for its feeding does not take much space in the start shaft either.

The invention is not restricted to the arrangements shown in the figures for supply and distribution of the pressurized medium for effecting the impacting movement, but it can use all arrangements known in the art. In the drawings, air acts as a pressurized medium, and it can thus be used also for flushing, but the invention can be applied also to cases where the medium is hydraulic and has a separate return channel and the flushing medium has a channel of its own. The invention can be used for the replacement of all kinds of underground pipes and pipe systems that have been used for transport of any substance, such as gas, water or sewage. The invention is applicable also to a variety of pipe materials, most commonly concrete or metal.

I claim:

1. Drilling apparatus provided for drilling away an existing underground pipe and for replacing it with a new pipe, said apparatus comprising:

a tubular body;

a percussive drill bit slidably connected to an end of said tubular body, said drill bit being capable of reciprocating movement with respect to said tubular body;

means for moving said percussive drill bit with respect to said tubular body to perform drilling operations at a drilling location;

a guiding element fixedly connected to the tubular body and axially passing through said tubular body and said drill bit to connect, in a direction of travel of the drilling apparatus, to advancing means causing the advancing movement of the tubular body, said guiding element and said percussive drill bit being axially movable relative to each other to prevent impacting movements from said drill bit from being transmitted to said guiding element; and a centering element consisting of a conveyor for conveying drill cuttings forward from the drilling location, said centering element being mounted on the guiding element.

2. The drilling apparatus according to claim 1, further comprising a channel in said guiding element for introducing to the tubular body at least one medium needed by the drilling operation.

* * * * *